US011655093B1

(12) United States Patent
Voorhees

(10) Patent No.: US 11,655,093 B1
(45) Date of Patent: May 23, 2023

(54) INTEGRALLY FORMED TRILOBULAR PACKAGING ELEMENT

(71) Applicant: RATIONAL PACKAGING LLC, Springfield, TN (US)

(72) Inventor: Samuel C. Voorhees, Louisville, KY (US)

(73) Assignee: RATIONAL PACKAGING LLC, Springfield, TN (US)

( * ) Notice: Subject to any disclaimer, the term of this patent is extended or adjusted under 35 U.S.C. 154(b) by 124 days.

(21) Appl. No.: 17/152,619

(22) Filed: Jan. 19, 2021

Related U.S. Application Data

(63) Continuation-in-part of application No. 16/520,072, filed on Jul. 23, 2019, now Pat. No. 11,104,501, and a continuation-in-part of application No. 16/244,676, filed on Jan. 10, 2019, now Pat. No. 10,899,524, and a continuation-in-part of application No. 29/667,164, filed on Oct. 18, 2018, now Pat. No. Des. 908,499, and a continuation-in-part of application No. 29/667,167, filed on Oct. 18, 2018, now Pat. No. Des. 908,005, and a continuation-in-part of application No. 29/667,165, filed on Oct. 18, 2018, now Pat. No. Des. 908,004, and a continuation-in-part of application No. 29/667,161, filed on Oct. 18, 2018, now Pat. No. Des. 908,003, which is a continuation-in-part of application No. 15/964,439, filed on Apr. 27, 2018, now Pat. No. 10,822,138, which is a continuation-in-part of application No. 29/593,147, filed on Feb. 6, 2017, and a continuation-in-part of application No. 29/593,144, filed on Feb. 6, 2017, now Pat. No. Des. 871,213.

(51) Int. Cl.
*B65D 81/05* (2006.01)

(52) U.S. Cl.
CPC ..... *B65D 81/053* (2013.01); *B65D 2581/053* (2013.01)

(58) Field of Classification Search
CPC ..... B65D 81/053; B65D 2581/053; B65D 81/054; B65D 81/05
USPC ..... 206/586, 521
See application file for complete search history.

(56) References Cited

U.S. PATENT DOCUMENTS 4,125,187 A * 11/1978 Vecchiotti ..... H01M 50/10 220/675
7,325,500 B2 * 2/2008 Carpenter ..... B65D 19/06 108/51.11

(Continued)

*Primary Examiner* — Steven A. Reynolds
(74) *Attorney, Agent, or Firm* — Shaddock Law Group, PC

(57) ABSTRACT

An integrally formed trilobular packaging element, including at least some of an integrally formed sheet having one or more alternating ridges and grooves, formed along a continuous outer wall of the sheet; a first extension portion defined along a portion of the sheet; a central portion defined along a portion of the sheet, extending from the first extension portion; a second extension portion, defined along a portion of the sheet, extending from the central portion to the first extension portion, wherein a vertex of a first lobe is defined between the first extension portion and the central portion, wherein a vertex of a second lobe is defined between the central portion and the second extension portion, and wherein a vertex of a third lobe is defined between the second extension portion and the first extension portion; and a deformable hollow defined within at least a portion of the sheet.

20 Claims, 10 Drawing Sheets

(56) References Cited

U.S. PATENT DOCUMENTS

| | | | | |
|---|---|---|---|---|
| 7,546,927 | B2 * | 6/2009 | Lowry | A47F 3/142 206/557 |
| 2005/0035257 | A1 * | 2/2005 | Niu | B65D 81/054 248/345.1 |
| 2008/0237419 | A1 * | 10/2008 | Baechle | B65D 19/20 248/219.2 |
| 2010/0187153 | A1 * | 7/2010 | Simms | B65D 81/054 206/586 |
| 2011/0266177 | A1 * | 11/2011 | Lowry | B65D 19/44 53/399 |
| 2011/0278310 | A1 * | 11/2011 | Muyskens | B65D 5/5033 220/646 |

* cited by examiner

INTEGRALLY FORMED TRILOBULAR PACKAGING ELEMENT

CROSS-REFERENCE TO RELATED APPLICATIONS

This patent application is a continuation-in-part of US Patent Application No. 29,667,167, filed Oct. 18, 2018, which is a continuation-in-part of U.S. patent application Ser. No. 29/593,144 filed Feb. 6, 2017, and is also a continuation-in-part of U.S. patent application Ser. No. 29/593,147, filed Feb. 6, 2017, and this patent application is also a continuation-in-part of U.S. patent application Ser. No. 16/520,072, filed Jul. 23, 2019, which is a continuation-in-part of U.S. patent application Ser. No. 16/244,676 filed Jan. 10, 2019, and is a continuation-in-part of U.S. patent application Ser. No. 29/667,165 filed Oct. 18, 2018, and is a continuation-in-part of U.S. patent application Ser. No. 29/667,164 filed Oct. 18, 2018, and is a continuation-in-part of U.S. patent application Ser. No. 29/667,161 filed Oct. 18, 2018, and is a continuation-in-part of U.S. patent application Ser. No. 15/964,439 filed Apr. 27, 2018, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging elements. More specifically, the present disclosure relates to an integrally formed trilobular packaging element.

2. Description of Related Art

It is generally known to use various packaging elements to package products for storage or shipping. Typically, packaging elements are constructed so as to stabilize the contained item or items and provide a certain degree of cushioning against breakage, while being moved or transported.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging elements have various shortcomings. Among other things, known packaging elements do not provide adequate filling of void spaces or cushioning between packaged products and the product packaging. Additionally, known packaging elements or assemblies do not provide a sufficient cushioning to the packaged article or product. Furthermore, known packaging assemblies and/or assembly components are cumbersome and have shapes that are not conducive to being packaged for shipment prior to assembly. Thus, shipping certain of the assembly components can be inefficient.

To overcome these and other shortcomings, the present disclosure provides a trilobular packaging element having a deformable hollow, which allows for a degree of inward and/or outward flexion and resilient recovery toward the original shape of the deformable hollow and/or the trilobular packaging element. The trilobular packaging element of the present disclosure also includes grooves and ridges that allow the trilobular packaging element to better resist crushing (or resist a determined amount of crushing).

In various exemplary embodiments, the trilobular packaging element may initially be provided in a more flattened position so that the amount of space occupied by the trilobular packaging element can be reduced and a greater number of trilobular packaging elements can be packaged within a given shipment package.

Additionally, one or more optional score marks may be included along portions of the trilobular packaging element to provide a line or portion along which the trilobular packaging element may be bent or folded. By bending or folding the trilobular packaging element along each score mark, a portion of the trilobular packaging element can be urged from an initial, formed position to a more flattened position. By providing the trilobular packaging element in a more flattened position, the amount of space occupied by the trilobular packaging element can be reduced and a greater number of trilobular packaging elements can be packaged within a given shipment package.

In various exemplary, nonlimiting embodiments, the trilobular packaging element of the present disclosure provides a multi-layer sheet or portion of material having a substantially sinusoidal or recurve shape along its entire length and including a deformable hollow formed by attaching or coupling and portions of the sheet together.

In various exemplary, nonlimiting embodiments, the trilobular packaging element of the present disclosure provides a multi-layer sheet having a recurve shape along its entire length and including a deformable cavity comprising three extending cavities, formed by attaching a first end portion of the sheet to a second end portion of the sheet.

In various exemplary, nonlimiting embodiments, the trilobular packaging element of the present disclosure provides two multi-layer sheets having a recurve shape along their entire length and including a deformable cavity formed by joining the two sheets proximate their respective end portions.

In various exemplary, nonlimiting embodiments, the trilobular packaging element of the present disclosure provides a multi-layer sheet having a recurve shape along its entire length, including two or more vertical slits or scores formed along a longitudinal axis of the sheet, and bending end portions of the sheet along the vertical slits or scores to produce an open, deformable post.

In various exemplary, non-limiting embodiments, the trilobular packaging element of the present disclosure comprises at least some of an integrally formed sheet formed of a portion of material, wherein the sheet extends from a first terminal end to a second terminal end; one or more alternating ridges and grooves, formed along a continuous outer wall of the sheet; a first extension portion defined along a portion of the sheet; a central portion defined along a portion of the sheet, extending from the first extension portion; a second extension portion, defined along a portion of the sheet, extending from the central portion to the first extension portion, wherein a vertex of a first lobe is defined between the first extension portion and the central portion, wherein a vertex of a second lobe is defined between the central portion and the second extension portion, and wherein a vertex of a third lobe is defined between the second extension portion and the first extension portion; and a deformable hollow defined within at least a portion of the sheet.

In certain exemplary, nonlimiting embodiments, the sheet is formed of one continuous piece or portion of a common material.

In certain exemplary, nonlimiting embodiments, the sheet extends continuously, from the first terminal end to the second terminal end.

In certain exemplary, nonlimiting embodiments, the sheet comprises a single layer of material.

In certain exemplary, nonlimiting embodiments, the sheet comprises a continuous portion of paperboard, chipboard, container board, box board, cardboard, or corrugated fiberboard.

In certain exemplary, nonlimiting embodiments, each of the alternating ridges and grooves extends substantially parallel to a longitudinal axis of the sheet, from the first terminal end to the second terminal end.

In certain exemplary, nonlimiting embodiments, the sheet is curvilinear along at least a portion of the continuous outer wall of the sheet.

In certain exemplary, nonlimiting embodiments, the alternating ridges and grooves form a sinusoidal or substantially sinusoidal succession of waves or curves.

In certain exemplary, nonlimiting embodiments, the alternating ridges and grooves form one or more recurving or recurved waves or curves.

In certain exemplary, nonlimiting embodiments, the integrally formed trilobular packaging element forms a substantially triangular or trilobular shape.

In certain exemplary, nonlimiting embodiments, an angle θ formed between the first extension portion and the central portion and an angle θ formed between the second extension portion and the central portion are substantially similar.

In certain exemplary, nonlimiting embodiments, an angle θ formed between the first extension portion and the central portion and an angle θ formed between the second extension portion and the central portion is approximately ±130°.

In certain exemplary, nonlimiting embodiments, an angle θ formed between the first extension portion and the central portion and an angle θ formed between the second extension portion and the central portion is between approximately ±120° and ±140°.

In certain exemplary, nonlimiting embodiments, an angle θ formed between the first extension portion and the central portion and an angle θ formed between the second extension portion and the central portion are acute angles.

In various exemplary, non-limiting embodiments, the trilobular packaging element of the present disclosure comprises at least some of an integrally formed portion of material, wherein the portion of material has a continuous outer wall; one or more alternating ridges and grooves, formed along the continuous outer wall of the portion of material; a first extension portion defined along a portion of the portion of material; a central portion defined along a portion of the portion of material, extending from the first extension portion; a second extension portion, defined along a portion of the portion of material, extending from the central portion to the first extension portion, wherein a vertex of a first lobe is defined between the first extension portion and the central portion, wherein a vertex of a second lobe is defined between the central portion and the second extension portion, and wherein a vertex of a third lobe is defined between the second extension portion and the first extension portion; and a deformable hollow defined within at least a portion of the portion of material.

In certain exemplary, nonlimiting embodiments, the continuous outer wall forms a substantially triangular or trilobular shape.

In certain exemplary, nonlimiting embodiments, the deformable hollow forms a substantially triangular or trilobular shape.

In certain exemplary, nonlimiting embodiments, the deformable hollow is defined by a continuous inner wall of the sheet.

In certain exemplary, nonlimiting embodiments, the deformable hollow is defined by a continuous inner wall of the sheet and wherein the continuous outer wall is substantially similarly shaped but offset from the continuous inner wall.

In various exemplary, non-limiting embodiments, the trilobular packaging element of the present disclosure comprises at least some of an integrally formed portion of material having a continuous outer wall and a substantially trilobular shape; one or more alternating ridges and grooves, formed along the continuous outer wall of the portion of material; a deformable hollow defined within at least a portion of the portion of material, wherein the deformable hollow is defined by a continuous inner wall, and wherein the continuous outer wall is substantially similarly shaped but offset from the continuous inner wall; a first extension portion defined along a portion of the portion of material; a central portion defined along a portion of the portion of material, extending from the first extension portion; and a second extension portion, defined along a portion of the portion of material, extending from the central portion to the first extension portion, wherein a vertex of a first lobe is defined between the first extension portion and the central portion, wherein a vertex of a second lobe is defined between the central portion and the second extension portion, and wherein a vertex of a third lobe is defined between the second extension portion and the first extension portion.

Accordingly, the present disclosure provides a trilobular packaging element that can be easily and accurately positioned relative to a packaged article or product, when needed.

The present disclosure separately provides a trilobular packaging element that provides lower costs for handling and storage.

The present disclosure separately provides a trilobular packaging element with a high degree of compressional strength.

The present disclosure separately provides a trilobular packaging element that provides an element for filling of void spaces or cushioning between packaged products and the product packaging.

The present disclosure separately provides a trilobular packaging element that provides an increased level of cushioning to a packaged article or product within a product package.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

For simplicity and clarification, the design factors and operating principles of the trilobular packaging element are explained with reference to various exemplary embodiments of a trilobular packaging element according to the present disclosure. The basic explanation of the design factors and operating principles of the trilobular packaging element is applicable for the understanding, design, and operation of the trilobular packaging element of the present disclosure. It should be appreciated that the trilobular packaging element can be adapted to applications where a packaging element can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging element" and "trilobular packaging element" are used for basic explanation and understanding of the operation of the systems, methods, and apparatuses of the present disclosure. Therefore, the terms "packaging element" and "trilobular packaging element" are not to be construed as limiting the systems, methods, and apparatuses of the present disclosure.

Figure 13:
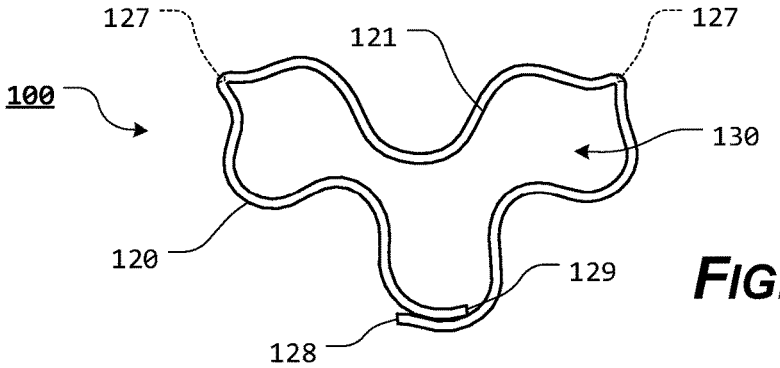
FIG. 13 illustrates a top view of an exemplary embodiment of a trilobular packaging element in a folded or formed position, according to the present disclosure.
Figure 14:
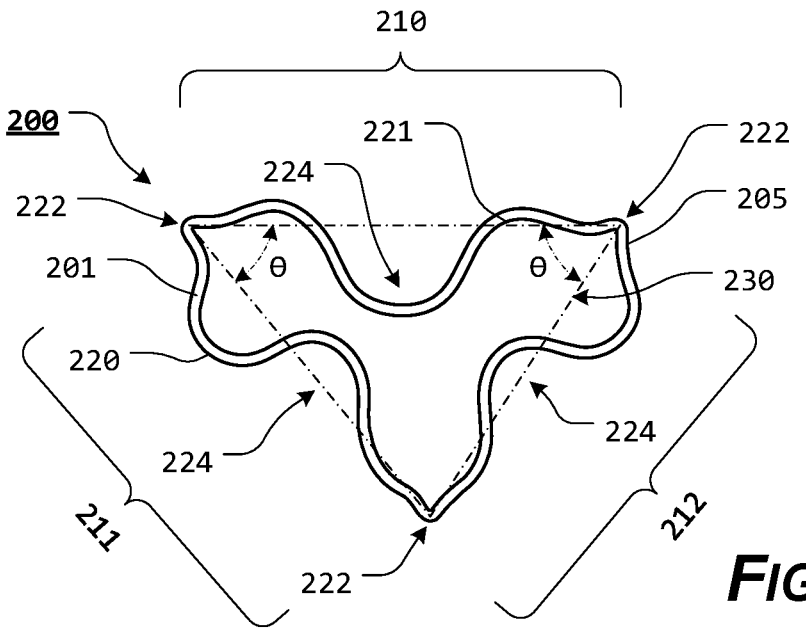
FIG. 14 illustrates a top view of an exemplary embodiment of a trilobular packaging element, according to the present disclosure.
Figure 15:
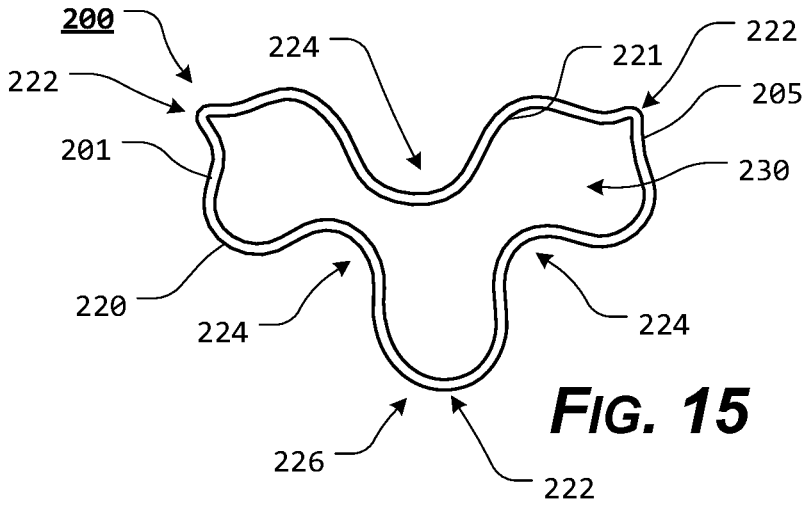
FIG. 15 illustrates a top view of an exemplary embodiment of a trilobular packaging element, according to the present disclosure.
Figure 16:
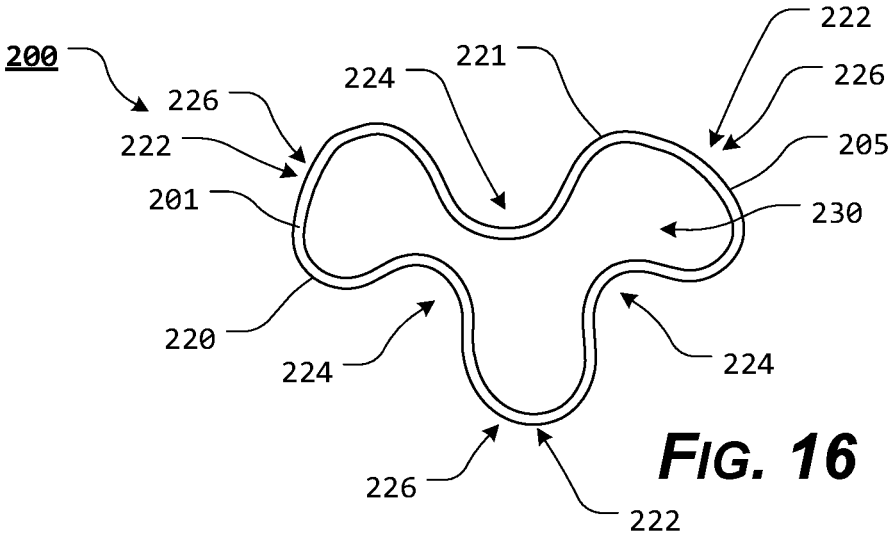
FIG. 16 illustrates a top view of an exemplary embodiment of a trilobular packaging element, according to the present disclosure.
Figure 17:
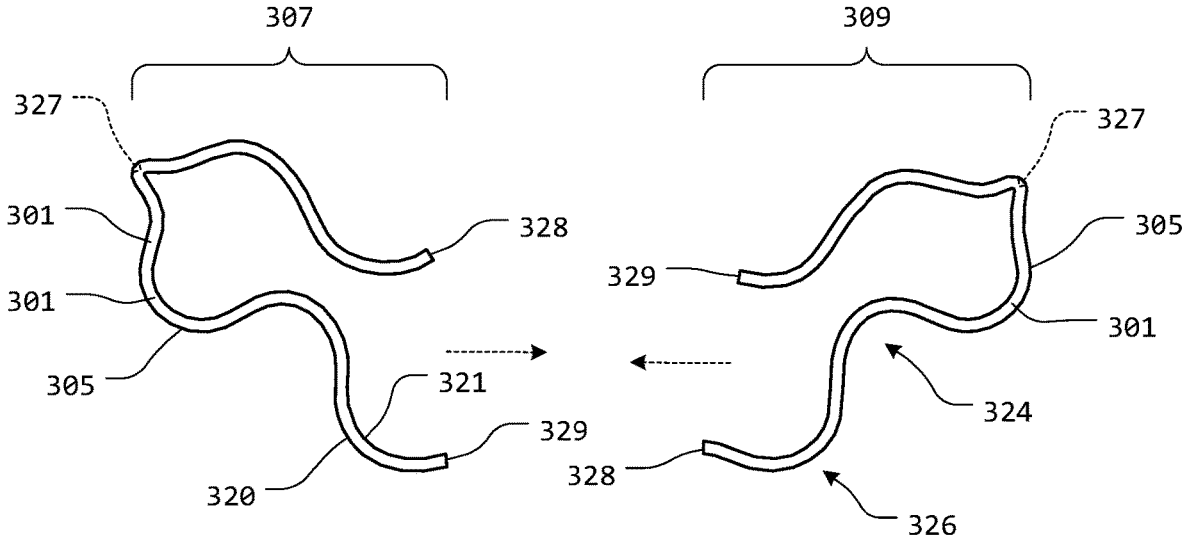
FIG. 17 illustrates a top view of an exemplary embodiment of a trilobular packaging element in a preassembled position, according to the present disclosure.
Figure 18:
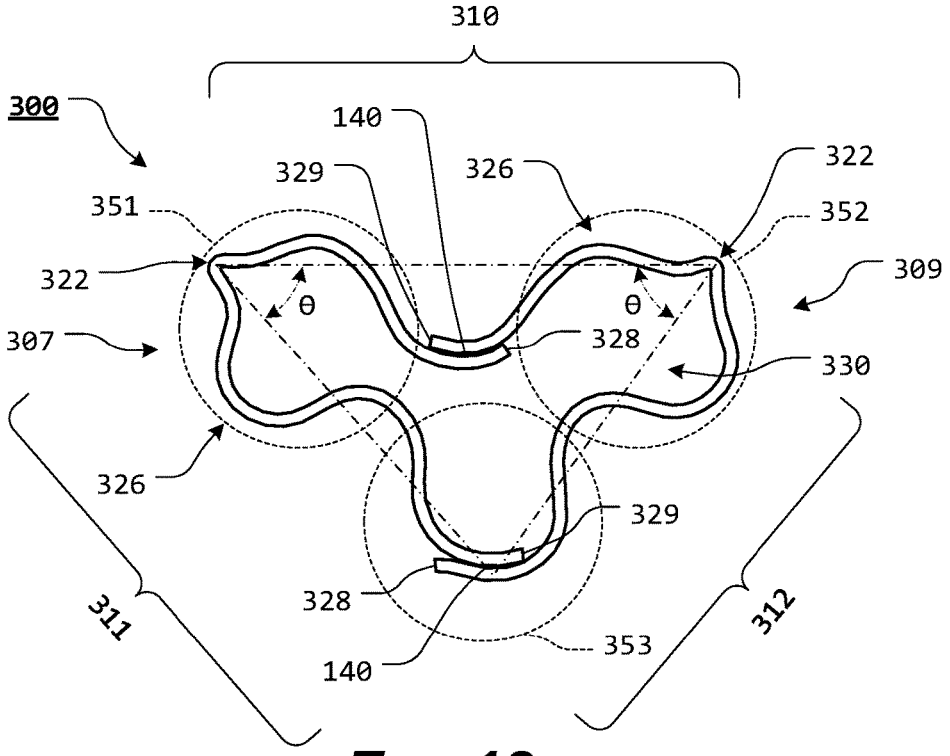
FIG. 18 illustrates a top view of an exemplary embodiment of a trilobular packaging element in an assembled position, according to the present disclosure.

Turning now to the appended drawing figures, FIGS. 1-13 illustrate certain elements and/or aspects of an exemplary embodiment of a trilobular packaging element 100, FIGS. 14-16 illustrate certain elements and/or aspects of alternative exemplary embodiments of an integrally formed trilobular packaging element 200, while FIGS. 17-18 illustrate certain elements and/or aspects of another alternative exemplary embodiment of a trilobular packaging element 100, according to the present disclosure.

In illustrative, non-limiting embodiment(s) of the present disclosure, as illustrated most clearly in FIGS. 1-13, the trilobular packaging element 100 comprises an elongate portion of material, formed of a sheet 105, which extends, along a longitudinal axis, $A_L$, from a first terminal end 101 to a second terminal end 102. In various exemplary embodiments, the sheet 105 extends continuously, in an uninterrupted manner, from the first terminal end 101 to the second terminal end 102.

The portion of material or sheet 105 also extends continuously, extending substantially parallel to a transverse axis, $A_T$ (substantially perpendicular to the longitudinal axis, $A_L$), from a terminating distal end 128 to a terminating proximal end 129.

In various exemplary embodiments, the material used to form the sheet 105 comprises a single layer of material. Alternatively, the material used to form sheet 105 comprises multiple layers of similar or dissimilar materials joined or adhesively bonded together to form the sheet 105. Thus, it should be appreciated that the sheet 105 may comprise a single layer of material or may be a multi-layer sheet 105 formed of a laminate of a plurality of layers of material attached or coupled by an adhesive or other means.

The sheet 105 may also be formed of a thick sheet, such as, for example, paperboard, chipboard, container board, box board, cardboard, or corrugated fiberboard.

In various exemplary embodiments, the sheet 105 is substantially rigid and is formed of cardboard. Alternate materials of construction of the sheet 105 may include one or more of the following: thick paper (of various types), pasteboard, paperboard, container board, corrugated fiberboard, box board, or chipboard. In still other exemplary embodiments, alternate materials of construction of the sheet 105 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the sheet 105 is a design choice based on the desired appearance and functionality of the sheet 105.

Figure 11:
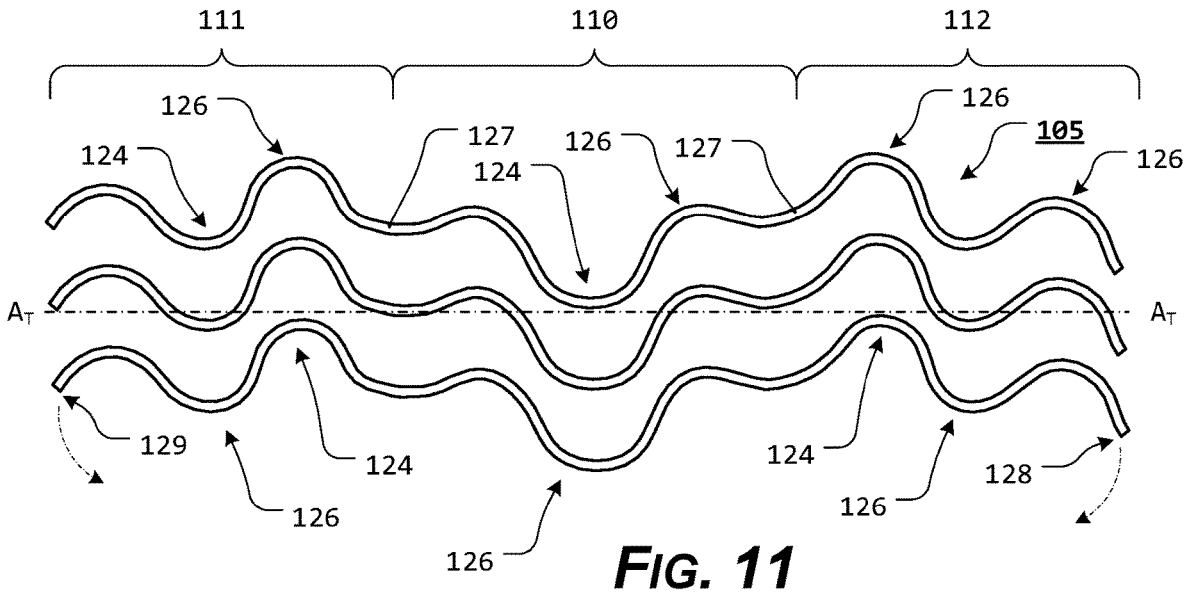
FIG. 11 illustrates a top view of several exemplary flattened sheets used to form a trilobular packaging element aligned together, according to the present disclosure.

As most easily seen when viewed from the top or bottom, as illustrated, for example, in FIG. 11, the sheet 105 includes one or more alternating ridges 126 and grooves 124, formed along the length of the sheet 105, from the terminating distal end 128 to the terminating proximal end 129. Each of the alternating ridges 126 and grooves 124 of the sheet 105 extends, along or substantially parallel to the longitudinal axis, $A_L$, of the trilobular packaging element 100. In certain exemplary, nonlimiting embodiments, each of the alternating ridges 126 and grooves 124 are parallel and alternating ridges 126 and grooves 124.

By including the alternating ridges 126 and grooves 124, the sheet 105 is curvilinear along its length, substantially parallel to a transverse axis, AT, from the terminating distal end 128 to the terminating proximal end 129. The alternating ridges 126 and grooves 124 may be formed such that the sheet 105 comprises a sinusoidal succession of waves or curves, along the length, from the terminating distal end 128 to the terminating proximal end 129.

In certain exemplary embodiments, the alternating ridges 126 and grooves 124 may be formed such that the sheet 105 comprises one or more recurving or recurved waves or curves, wherein at least certain of the alternating ridges 126 and/or grooves 124 curve or turn in a backwards or reverse direction, relative to one another, along the length, from the terminating distal end 128 to the terminating proximal end 129.

Because of the inclusion of the alternating ridges 126 and grooves 124, the sheet 105, the central portion 110, the second extension portion 112, and the trilobular packaging element 100, are better able to resist end to end compression, along or parallel to the longitudinal axis, $A_L$, of the trilobular packaging element 100. Additionally, the inclusion of the alternating ridges 126 and grooves 124 helps each of the central portion 110, the first extension portion 111, and the second extension portion 112 to better resist crushing (or resist a determined amount of crushing), when forces are applied to the outer wall 120 and/or the inner wall 121.

The alternating ridges 126 and grooves 124 allow for a degree of inward and/or outward flexion and resilient recovery toward the original shape of the various portions of the sheet 105.

As further illustrated, for example, in FIG. 11, the sheet 105 generally includes a central portion 110, a first extension portion 111, and a second extension portion 112. The first extension portion 111 and the second extension portion 112 extend from opposing and's of the central portion 110.

An outer wall 120 forms an exterior surface of the sheet 105, while an inner wall 121 forms and interior surface of the sheet 105. As used herein, the terms "outer", "exterior", "inner", and "interior" are used for reference only and are not to be viewed as limiting the present disclosure. In certain exemplary, non-limiting embodiments, the outer wall 120 of the sheet 105 is substantially similarly shaped but offset from the inner wall 121 of the sheet 105.

As illustrated in FIG. 11, the sheet 105 may initially be presented in the more flattened position. In this position, the ridges 126 and grooves 124 are not flattened, but the overall sheet 105 is provided in an unfolded or "flattened" configuration. Because the sheet 105 may initially be presented in the more flattened position, as illustrated in FIG. 11, a plurality of sheets 105 can be positioned atop one another and alternating ridges 126 of a first sheet 105 can be "nested" within at least a portion of certain alternating grooves 124 of a second sheet 105. Thus, the area required for the sheet 105 allows sheets 105 to be more densely packaged in a particular packaging container.

Figure 12:
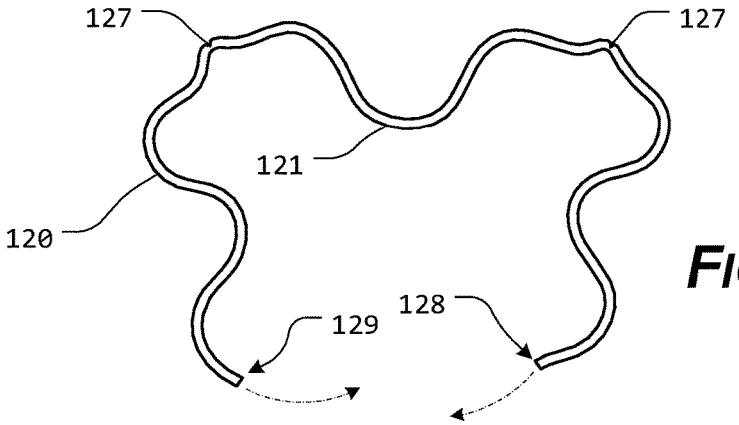
FIG. 12 illustrates a top view of an exemplary embodiment of a trilobular packaging element in a partially folded position, according to the present disclosure.

If provided in a flattened condition, each sheet 105 can be folded or bent by the user, as illustrated in FIGS. 12-13, to form a trilobular packaging element 100. In certain alternative embodiments, the trilobular packaging element 100 may optionally be provided in a pre-bent configuration.

During assembly, as illustrated in FIGS. 12-13, the first extension portion 111 and the second extension portion 112 are folded or bent, relative to the central portion 110. The first extension portion 111 and the second extension portion 112 are folded or bent such that the terminating distal end 128 overlaps the terminating proximal end 129 and at least a portion of the outer wall 120 of the sheet 105 proximate the terminating proximal end 129. Once appropriately bent or folded, an area of the outer wall 120, proximate the terminating proximal end 129 may be attached or coupled to a portion of the inner wall 121, proximate the terminating distal end 128.

In various exemplary embodiments, an area of the outer wall 120, proximate the terminating proximal end 129 may be attached or coupled to a portion of the inner wall 121, proximate the terminating distal end 128 via an adhesive 140. It should be appreciated that in an alternative embodiment, an area of the inner wall 121, proximate the terminating proximal end 129 may be attached or coupled to a portion of the outer wall 120, proximate the terminating distal end 128.

If attached or coupled by an adhesive 140, the adhesive 140 may comprise, for example, a hot melt, reactive hot melt, thermosetting, pressure sensitive, contact, binary, or other adhesive. In some embodiments, the wall portions may be pre-glued or may include an adhesive 140 that is initially covered by a removable strip so that the wall portions may be adhesively attached or coupled to one another by a user. Alternatively, an area proximate the terminating proximal end 129 may be attached or coupled to a portion of the inner wall 121, via a mechanical or other means, such as, for example, stapling. In still other exemplary embodiments, the area of the outer wall 120 may be held in a desired position relative to a portion of the inner wall 121 by forces applied to at least a portion of the outer wall 120, when the trilobular packaging element 100 is positioned within a package (typically between an inner wall of the package and an outer portion of the packaged article or product).

In various exemplary embodiments, when appropriately bent or folded, the sheet 105 forms a substantially triangular or trilobular packaging element 100, when viewed from the top or bottom, having wall segments that include a corrugated wall portion having one or more alternating ridges 126 and/or grooves 124. In various exemplary embodiments, as illustrated, the trilobular packaging element 100 may optionally include three portions or lobes 151, 152, and 153. In these exemplary embodiments, each of the three "lobes" extends to a vertex 122. Generally, each vertex 122 defines the furthest extent of each respective lobe 151, 152, or 153.

Figure 1:
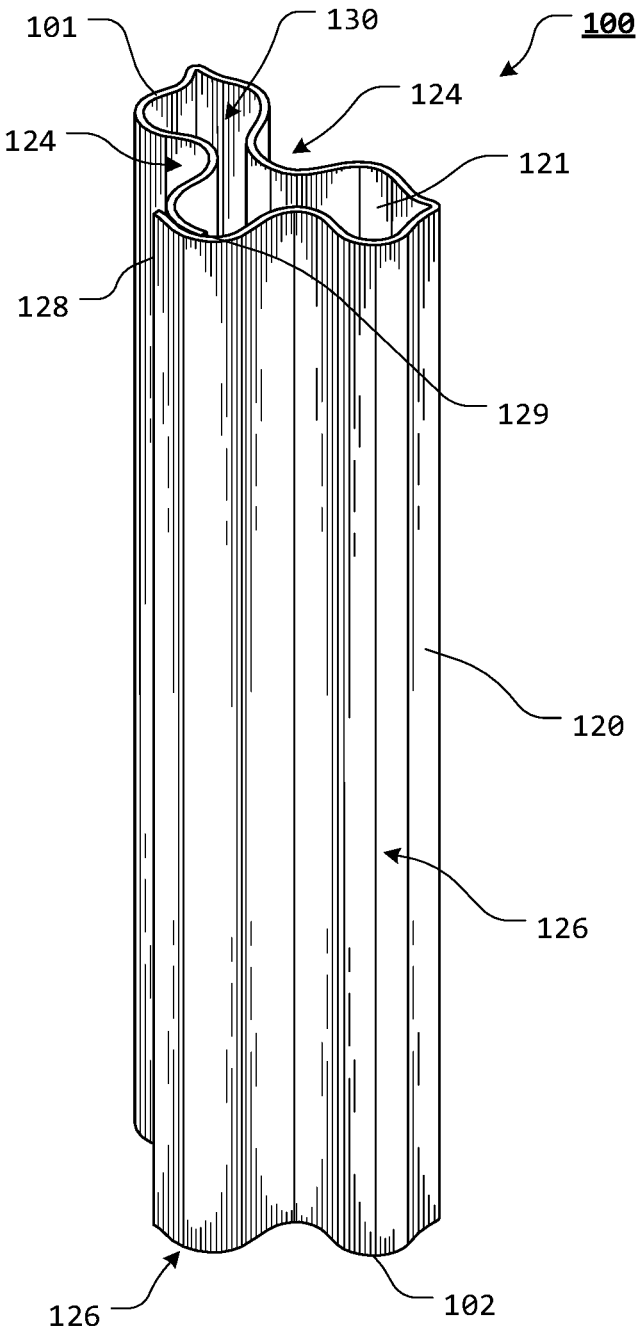
FIG. 1 illustrates an upper, front, right perspective view of an exemplary embodiment of a trilobular packaging element, according to the present disclosure.
Figure 2:
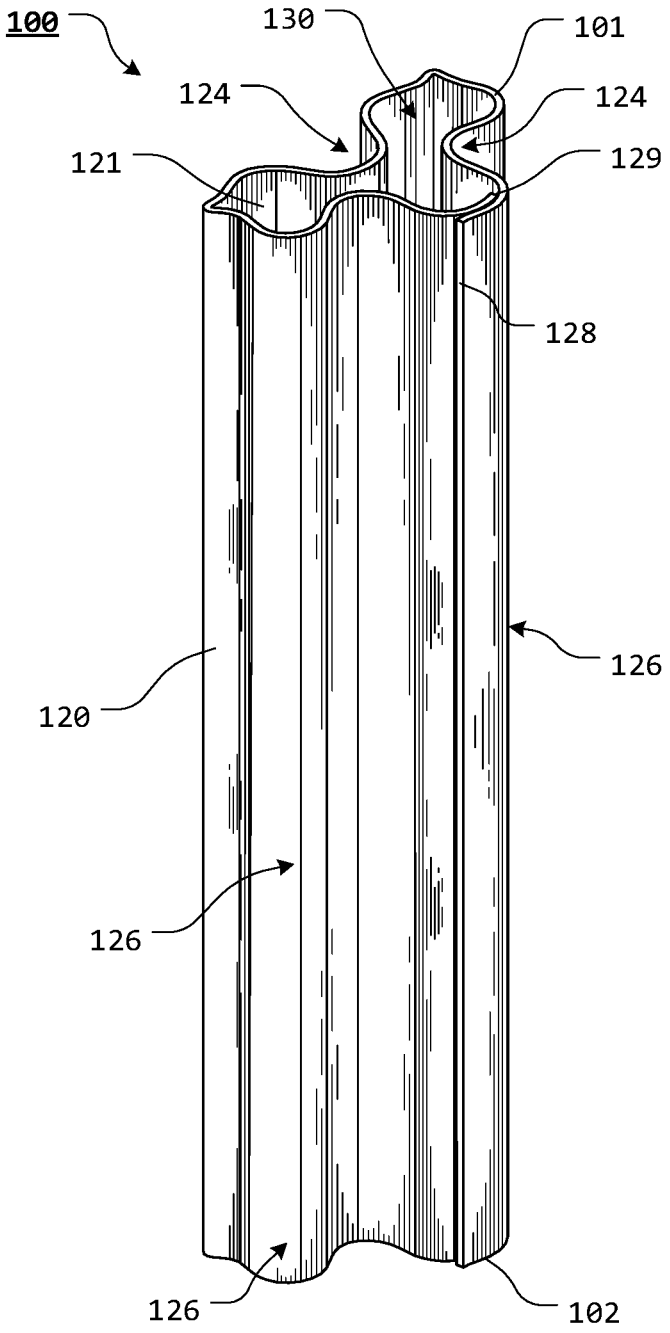
FIG. 2 illustrates an upper, front, left perspective view of an exemplary embodiment of a trilobular packaging element, according to the present disclosure.
Figure 3:
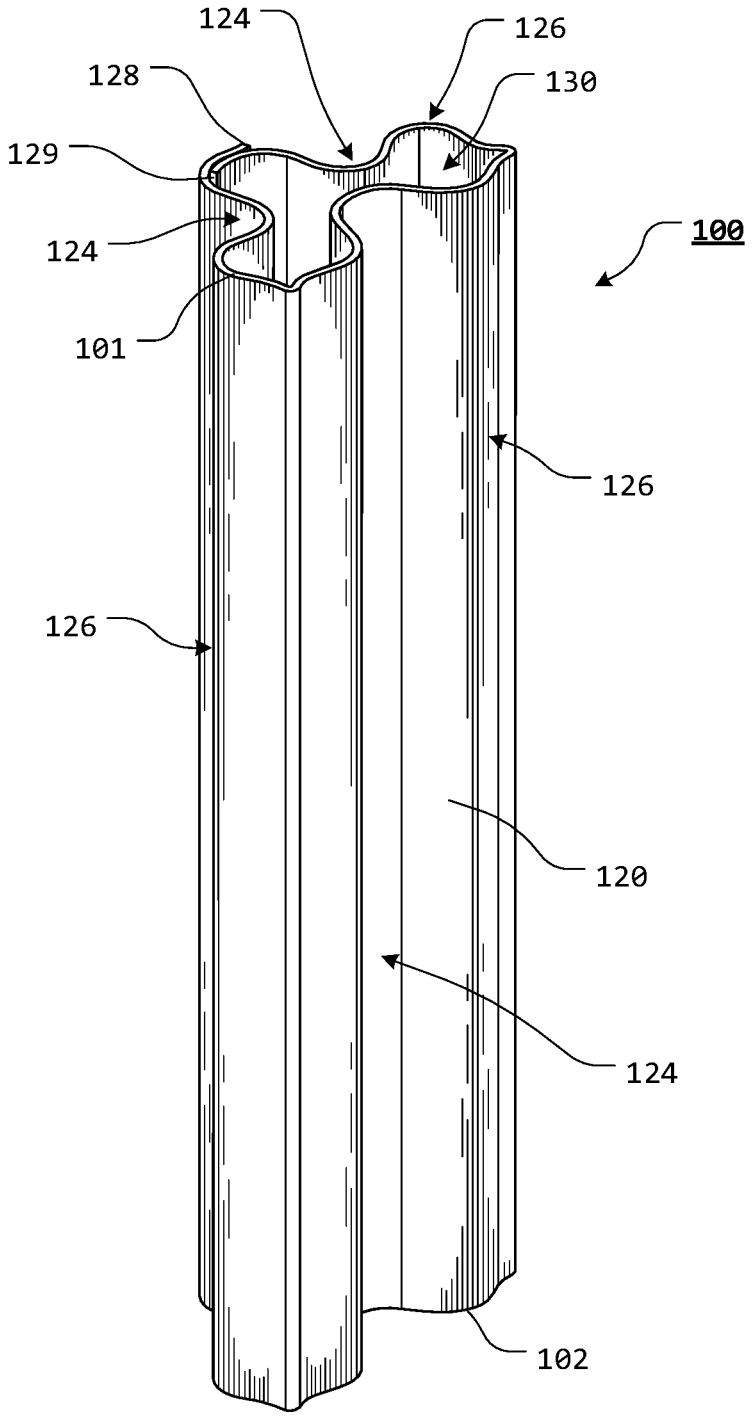
FIG. 3 illustrates an upper, rear, right perspective view of an exemplary embodiment of a trilobular packaging element, according to the present disclosure.
Figure 4:
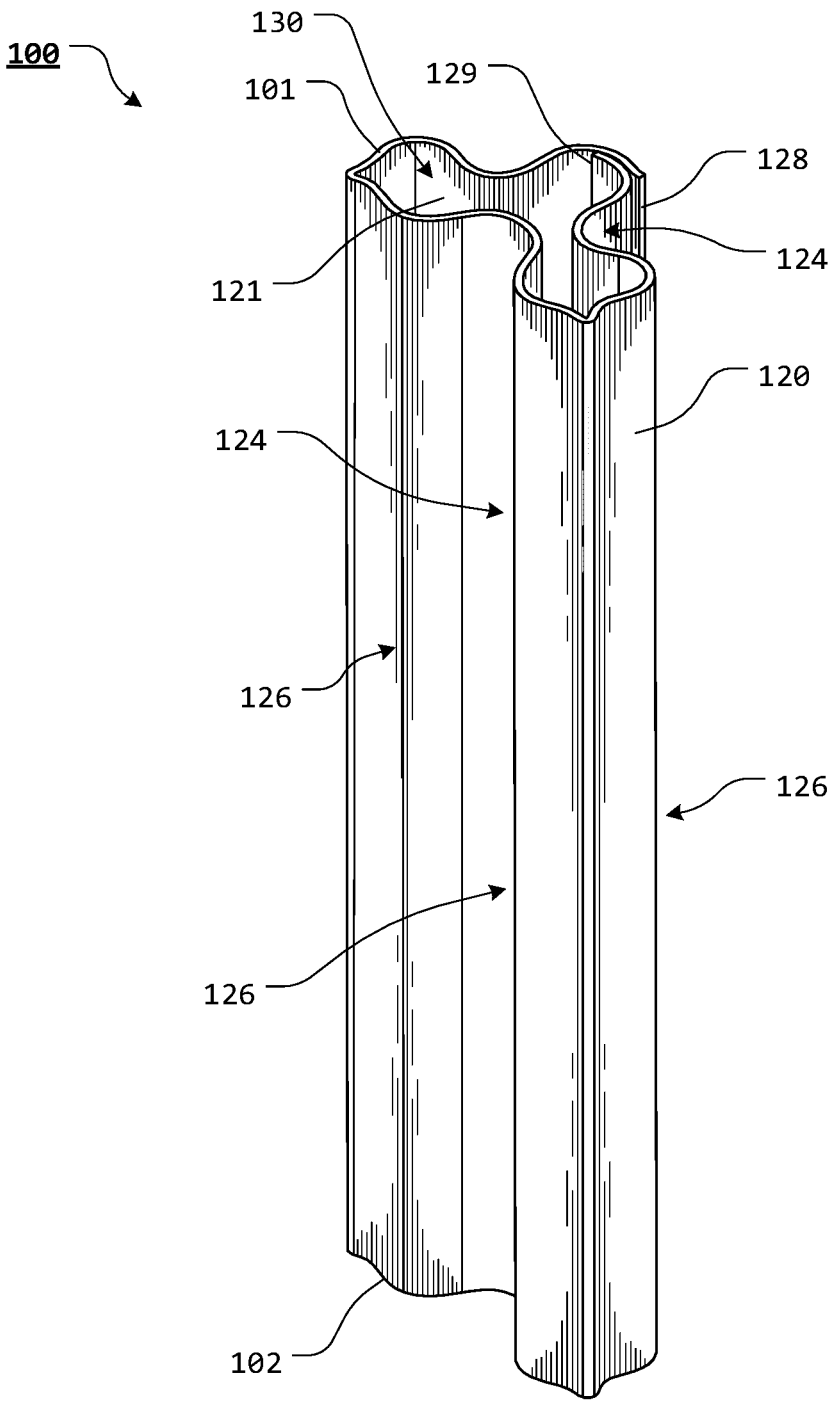
FIG. 4 illustrates an upper, rear, left perspective view of an exemplary embodiment of a trilobular packaging element, according to the present disclosure.
Figure 5:
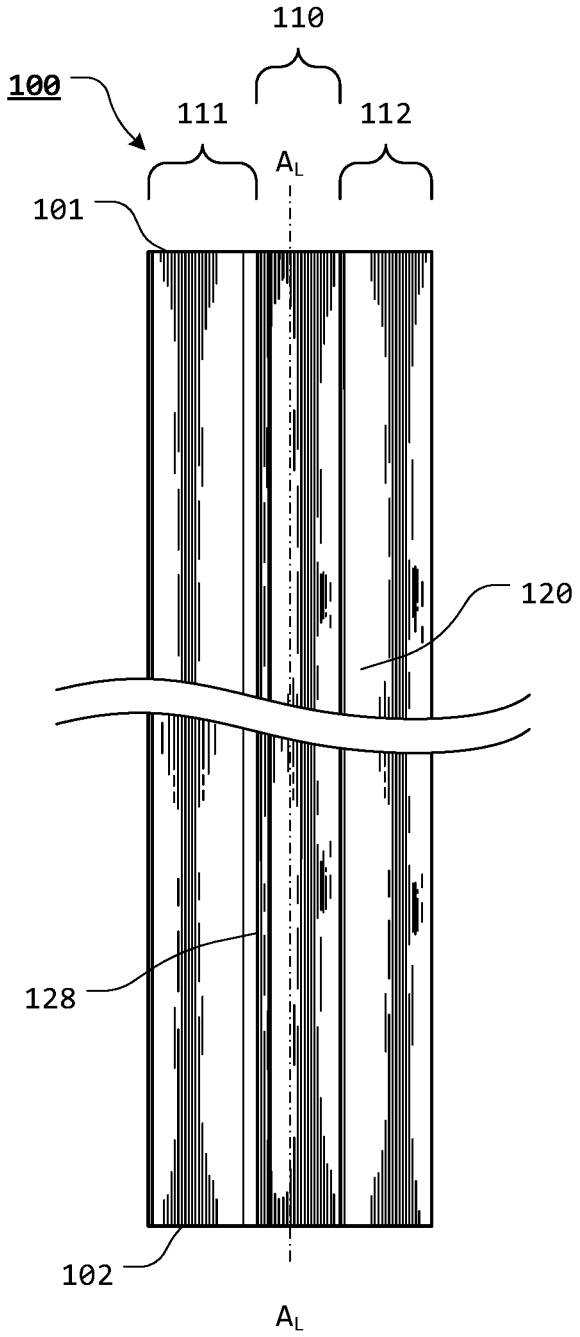
FIG. 5 illustrates a front side view of an exemplary embodiment of a trilobular packaging element, according to the present disclosure.
Figure 6:
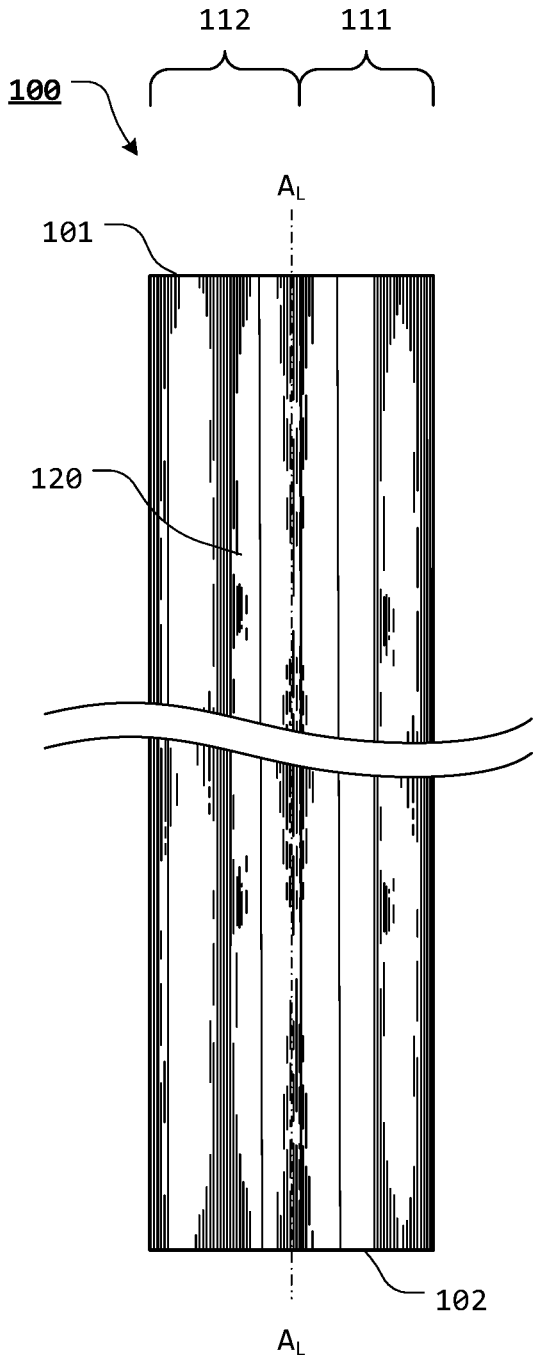
FIG. 6 illustrates a rear side view of an exemplary embodiment of a trilobular packaging element, according to the present disclosure.
Figure 7:
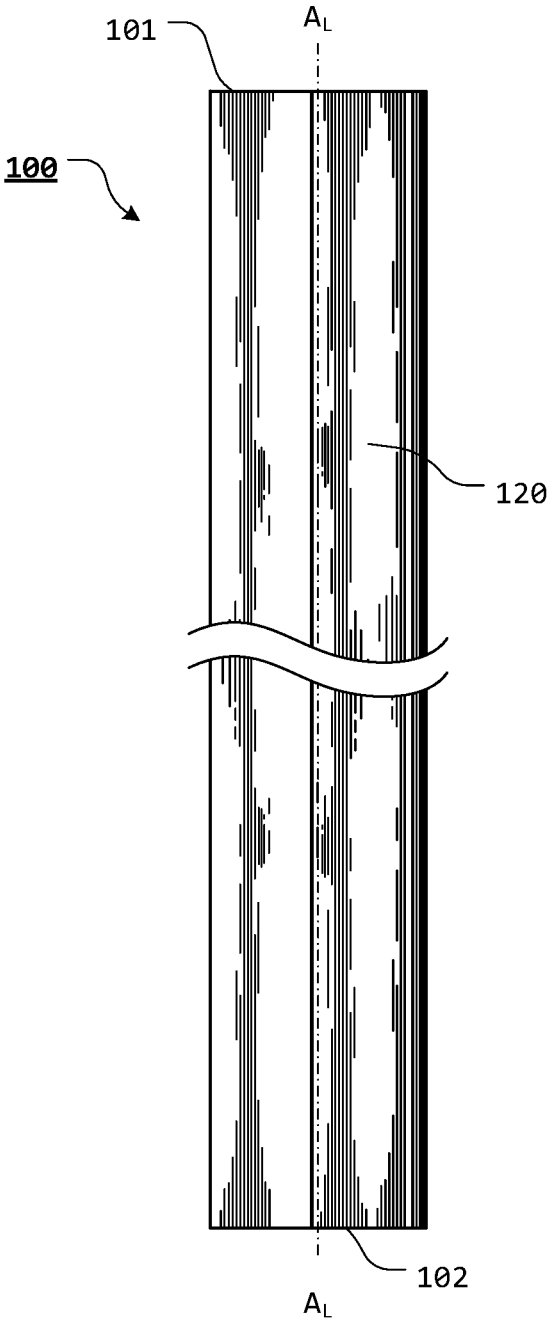
FIG. 7 illustrates a right view of an exemplary embodiment of a trilobular packaging element, according to the present disclosure.
Figure 8:
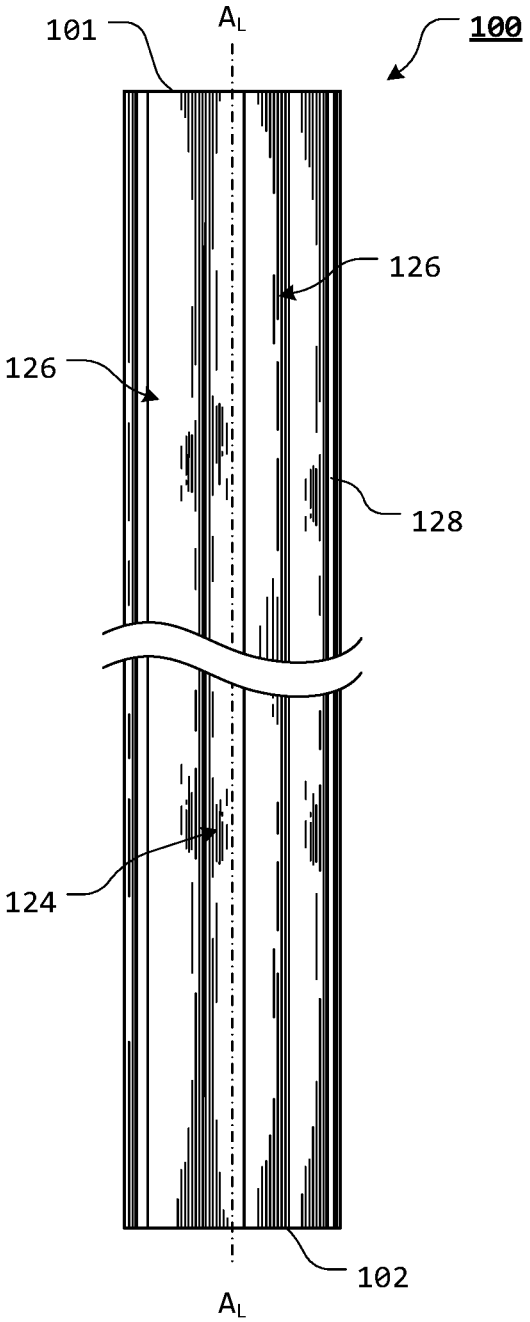
FIG. 8 illustrates a left view of an exemplary embodiment of a trilobular packaging element, according to the present disclosure.
Figure 9:
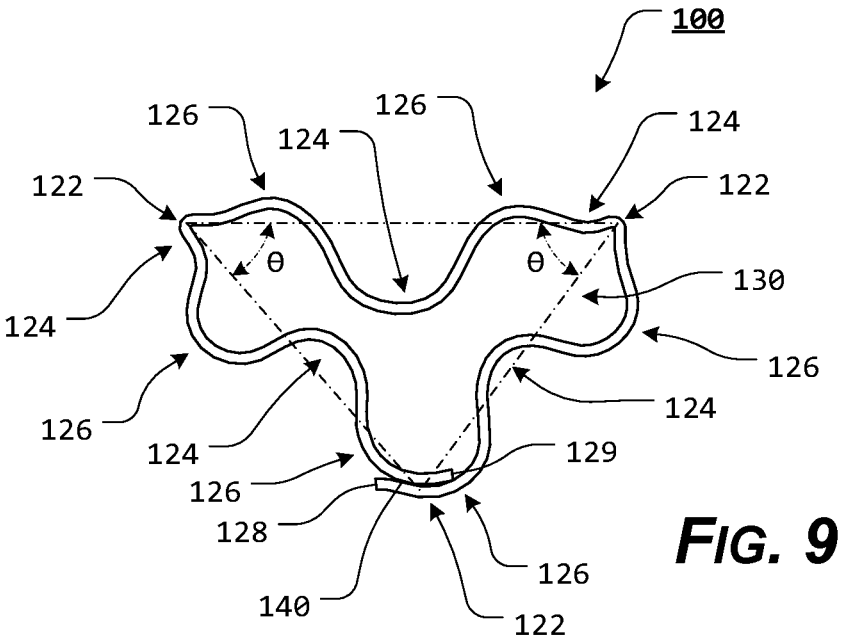
FIG. 9 illustrates a top view of an exemplary embodiment of a trilobular packaging element, according to the present disclosure.
Figure 10:
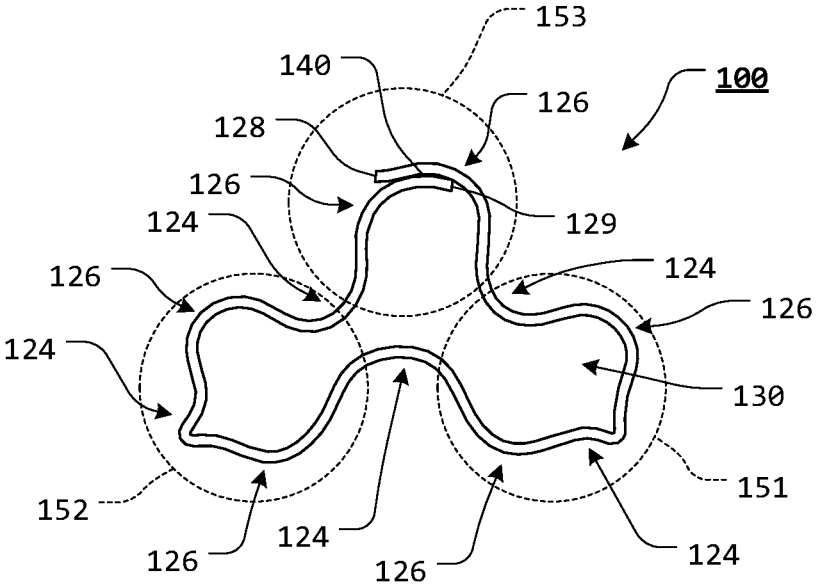
FIG. 10 illustrates a bottom view of an exemplary embodiment of a trilobular packaging element, according to the present disclosure.

In certain exemplary, nonlimiting embodiments, as illustrated in FIG. 9, when appropriately bent or folded, an angle θ formed between the first extension portion 111 and the central portion 110 and an angle θ formed between the second extension portion 112 and the central portion 110 are substantially similar. In various exemplary embodiments, the angle θ is approximately ±130°. In certain other exemplary, nonlimiting embodiments, the angle θ is between approximately ±120° and ±140°. In still other exemplary, nonlimiting embodiments, the angle θ is an acute angle.

As illustrated, each respective lobe 151, 152, and 153 includes a wider or comparatively more bulbous portion extending from each respective vertex 122 toward a narrower portion. Each narrower portion is generally formed by opposing portions of grooves 124.

In certain exemplary embodiments, the structure or grain of the sheet 105 may make it difficult to create an even bend or fold along a portion of the sheet 105. To allow portions of the sheet 105 to be comparatively more easily bent or folded, an optional score mark 127 may be formed between the first extension portion 111 and the central portion 110 and an optional score mark 127 may also be formed between the second extension portion 112 and the central portion 110. Providing score marks 127 allows the material of the trilobular packaging element 100 or the sheet 105 to form or more easily form a bend or fold or more easily form an even or consistent bend or fold.

In certain exemplary, nonlimiting embodiments, each score mark 127 is formed of a complete or partial recess or depression in the portion of material or sheet 105 extending substantially parallel to or extending substantially parallel to the longitudinal axis, $A_L$, of the sheet 105 and the trilobular packaging element 100.

In various exemplary embodiments, each score mark 127 may be formed of a compressed area of the sheet 105, without creating a cut. Alternatively, each score mark 127 may be formed of a partial cut through the portion of material or sheet 105.

In certain exemplary embodiments, each score mark 127 is formed in a portion of the outer wall 120 or exterior surface of the sheet 105. Alternatively, each score mark 127 may optionally be formed in a portion of the inner wall 121 or interior surface of the sheet 105.

In certain exemplary embodiments, each score mark 127 extends from the first terminal end 101 to the second terminal end 102. Alternatively, each score mark 127 may extend from an area proximate the first terminal end 101 to an area proximate the second terminal end 102.

Each score mark 127 may optionally be a complete or partial perforation of the sheet 105, extending into or through at least a portion of the outer wall 120. Each score mark 127 may optionally be a continuous or uninterrupted score mark or him perforation. Alternatively, each score mark 127 may optionally be a broken or segmented score mark or perforation.

In various exemplary embodiments, the score marks 127 are formed substantially equidistant from the terminating distal end 128 and the terminating proximal end 129. Alternatively, a score mark 127 may be formed closer to the terminating distal end 128 or the terminating proximal end 129. If each score mark 127 is formed closer to, for example, the terminating distal end 128, when appropriately bent or folded, the terminating proximal end 129 may extend further beyond the terminating distal end 128.

Each score mark 127 provides a line or portion along which the sheet 105 may be comparatively more easily bent or folded, whether along the grain or against the grain of the sheet 105. Thus, each score mark 127 may optionally provide a compressed or weakened area or portion of the sheet 105, along which the sheet 105 may be comparatively more easily bent or folded.

In various exemplary embodiments, each score mark 127 is formed within at least a portion of a groove 124.

By bending or folding the sheet 105 along each score mark 127, as illustrated by the semicircular arrows in FIGS. 11-12, a portion of the sheet 105 can be more easily manipulated from the more flattened position, as illustrated in FIG. 11, to form the trilobular packaging element 100.

The trilobular packaging element 100 may be constructed having an any desired overall size or shape. It should also be understood that the overall size and shape of the trilobular packaging element 100, and the various portions thereof, is a design choice based upon the desired functionality, compatibility with desired articles or products and/or appearance of the trilobular packaging element 100.

Thus, it should be appreciated that the overall length, width, and/or height of the central portion 110, the first extension portion 111, and the second extension portion 112 is a design choice, based upon the desired degree of packaging or cushioning provided by the trilobular packaging element 100 and/or the size and shape of the article or product with which the trilobular packaging element 100 is to be utilized.

A deformable hollow 130 is formed or defined within the trilobular packaging element 100. For example, the deformable hollow 130 may be formed by a portion of the inner wall 121 within the central portion 110, the first extension portion 111, and the second extension portion 112. The deformable hollow 130 provides a continuous hollow portion, extending between the first terminal end 101 and the second terminal end 102.

In certain exemplary, nonlimiting embodiments, at least a portion of the outer wall 120 and/or the inner wall 121 may be textured or may include an adhesive portion to provide a surface or area having a desired degree of friction or adhesive bonding relative to a product or product packaging. Thus, at least a portion of the trilobular packaging element 100 may be formed so as to resist movement of the trilobular packaging element 100 relative to a surface.

During use, the trilobular packaging element 100 is positioned between an article or product and an inner surface of a package within which the article or product is to be at least partially positioned. Typically, the trilobular packaging element 100 is positioned within a void formed between the article or product and an inner surface of the product packaging. Depending on the configuration of the package and article or product, one or more portions of the outer wall 120 contact portions of the surface of the interior of the product packaging and/or the article of or product to maintain the article or product in a desired position relative to the product packaging and provide package cushioning or support to the article or product during shipping, transport, or storage. In certain alternative embodiments, apexes of alternating ridges 126 contact portions of the surface of the interior of the product packaging and the article or product to maintain the article or product in a desired position relative to the product packaging and provide package cushioning or support to the article or product during shipping, transport, or storage.

In certain exemplary embodiments, adhesives may be utilized to further secure the trilobular packaging element 100 in a desired position relative to either the article or product or to the product packaging.

During shipping, transport, or storage of the article or product, the trilobular packaging element 100 helps to resist movement of the article or product within the product packaging. Additionally, if the product packaging is bumped or jarred, causing the article or product to shift within the product packaging, the alternating ridges 126 and grooves 124 allow for a degree of inward and/or outward flexion and resilient recovery toward the original shape of the trilobular packaging element 100. Furthermore, the deformable hollow 130 may partially or completely deform to absorb impact between the article or product in the product packaging. Similarly, if an item impacts the exterior of the product packaging, the deformable hollow 130 may partially or completely deform to absorb impact between the product packaging and the article or product.

FIGS. 14-16 illustrate certain elements and/or aspects of various exemplary embodiments of an integrally formed trilobular packaging element 200, according to the present disclosure. As illustrated in FIGS. 14-16, the integrally formed trilobular packaging element 200 comprises at least some of a sheet 205 extending from a first terminal end 201 to a second terminal end 202 (not labeled), having an outer wall 220 and an inner wall 221, a plurality of grooves 224 and ridges 226, a deformable hollow 230, a central portion 210, a first extension portion 211, a second extension portion 212, and lobes 251, 252, and 253 (not labeled).

It should be understood that these components and/or elements correspond to and operate similarly to the sheet 105, the first terminal end 101, the second terminal end 102, the outer wall 120, the inner wall 121, the grooves 124, the ridges 126, the deformable hollow 130, the central portion 110, the first extension portion 111, the second extension portion 112, and the lobes 151, 152, and 153, as described above with reference to the trilobular packaging element 100.

However, as illustrated in FIGS. 14-16, the integrally formed trilobular packaging element 200 does not include a terminating distal end or a terminating proximal end. Instead, the sheet 205 is formed of a material, as described above with respect to the sheet 105, but is formed as an integrally formed sheet or portion of material having a continuous outer wall 220 and a continuous inner wall 221.

In various exemplary embodiments, the sheet 205 may optionally be formed of a single layer, continuous portion of material that is formed into a hollow cylinder. Alternatively, the sheet 205 may optionally comprise multiple layers of similar or dissimilar materials joined or adhesively bonded together to form the sheet 205. Thus, it should be appreciated that the sheet 205 may comprise a single layer of material or may be a multi-layer sheet 205 formed of a laminate of a plurality of layers of material attached or coupled by an adhesive or other means.

It should be appreciated that the integrally formed trilobular packaging element 200 and/or the sheet 205 are integrally formed in that the sheet 205 is formed of one continuous piece or portion of a common material, is continuous in form in that the components making up the sheet 205 have been rendered inseparable (not ultimately inseparable, but practically inseparable as removal or separation of components would require or result in a destroyed or weakened sheet 205), is formed of two or more components joined by another material (such as, for example, an adhesive).

During construction or formation of the of the integrally formed trilobular packaging element 200, the sheet 205 may optionally be formed into a hollow cylinder. Depressions are formed in the outer wall 220 to form each of the grooves. The areas between the depression formed grooves 224 form the ridges 226.

It should also be appreciated that with respect to the trilobular packaging element 200, the first extension portion 211 and the second extension portion 212 are not formed by folding relative to the central portion 210, but are formed integral to the trilobular packaging element 200. Thus, the first extension portion 211 is defined along a portion of the sheet 205. A central portion 210 is defined along a portion of the sheet 205, extending from the first extension portion 211. The second extension portion 212 is defined along a portion of the sheet 205, extending from the central portion 210 to the first extension portion 211.

In these exemplary embodiments, a first lobe 251 is defined between the first extension portion 211 and said central portion 210, the second lobe 252 is defined between the central portion 210 and said second extension portion 212, and the third lobe 253 is defined between the second extension portion 212 and said first extension portion 211. The deformable hollow 230 is defined within at least a portion of the inner wall 221 of said sheet 205. In various exemplary embodiments, each of the three "lobes" 251, 252, and 253 extends to a vertex 222.

As illustrated, the overall shape of each of the lobes 251, 252, and 253 (not labeled) is a design choice and may vary slightly. For example, one or more of the lobes 251, 252, and/or 253 may extend to a relative point or apex or may comprise more arcuate or smoothly curved lobes.

FIGS. 17-18 illustrate certain elements and/or aspects of an exemplary embodiment of a bifurcated trilobular packaging element 300, according to the present disclosure. As illustrated in FIGS. 17-18, the bifurcated trilobular packaging element 300 comprises at least some of a sheet 305 extending from a first terminal end 301 to a second terminal end 302 (not shown), between a terminating distal end 328 and a terminating proximal end 329, having an outer wall 320 and an inner wall 321, a plurality of grooves 324 and ridges 326, an optional score mark 327, an adhesive 340, a deformable hollow 330, a central portion 310, a first extension portion 311, and a second extension portion 312, and lobes 351, 352, and 353.

It should be understood that these components and/or elements correspond to and operate similarly to the sheet 105, the first terminal end 101, the second terminal end 102, the terminating distal end 128, the terminating proximal end 129, the outer wall 120, the inner wall 121, the grooves 124, the ridges 126, the optional score mark 127, the adhesive 140, the deformable hollow 130, the central portion 110, the first extension portion 111, the second extension portion 112, and the lobes 151, 152, and 153, as described above with reference to the trilobular packaging element 100.

However, as illustrated in FIGS. 17-18, two half portions 307 and 309 of the bifurcated trilobular packaging element 300 are provided. The first sheet portion 307 is bent or folded between the terminating proximal end 329 and the terminating distal end 328 to form an apex 322 between the terminating proximal end 329 and said terminating distal end 328 of the first sheet portion 307. Similarly, the second sheet portion 309 is bent or folded between the terminating proximal end 329 and the terminating distal end 328 to form an apex 322 between the terminating proximal end 329 and said terminating distal end 328 of the second sheet portion 309.

The first sheet portion 307 and second sheet portion 309 comprise mirror image or substantially mirror image portions of sheet 305. Each of the portions 307 and 309 extends from a terminating distal end 328 to a terminating proximal end 329 and includes a plurality of grooves 324 and ridges 326.

Each of the half portions 307 and 309 are formed so that a terminating distal end 328 of a first sheet portion 307 can be aligned with a terminating proximal end 329 of a second sheet portion 309. Similarly, a terminating proximal end 329 of the first sheet portion 307 can be aligned with a terminating distal end 328 of the second sheet portion 309, as illustrated in FIG. 17.

During assembly, as illustrated in FIGS. 17-18, once portions of the first sheet portion 307 and second sheet portion 309 are appropriately aligned, the first sheet portion 307 and the second sheet portion 309 can be urged toward one another until the terminating distal end 328 of the first sheet portion 307 overlaps the terminating proximal end 329 of the second sheet portion 309 and at least a portion of the inner wall 321 of the sheet 305 of the second sheet portion 309, proximate the terminating proximal end 329 of the second sheet portion 309. Similarly, the terminating distal end 328 of the second sheet portion 309 overlaps the terminating proximal end 329 of the first sheet portion 307 and at least a portion of the outer wall 320 of the sheet 305 of the first sheet portion 307, proximate the terminating proximal end 329 of the first sheet portion 307.

Once appropriately overlapped, an area of the outer wall 320 of the first sheet portion 307, between the overlapped terminating proximal end 329 of the first sheet portion 307 and the terminating distal end 328 of the second sheet portion 309 may be attached or coupled (in any manner as described with respect to the trilobular packaging element 100) to a portion of the inner wall 321 of the second sheet portion 309, proximate the terminating distal end 328 of the second sheet portion 309.

Similarly, an area of the outer wall 320 of the first sheet portion 307, between the overlapped terminating distal end 328 of the first sheet portion 307 and the terminating proximal end 329 of the second sheet portion 309 may be attached or coupled (in any manner as described with respect to the trilobular packaging element 100) to a portion of the inner wall 321 of the second sheet portion 309, proximate the terminating proximal end 329 of the second sheet portion 309.

It should be appreciated that the trilobular packaging element 300 may be assembled by overlying a portion of the sheet 305 proximate the terminating distal end 328 of the first sheet portion 307 over a corresponding portion of the sheet 305 proximate the terminating proximal end 329 of the second sheet portion 309 or by overlying a portion of the sheet 305 proximate the terminating proximal end 329 of the second sheet portion 309 over a corresponding portion of the sheet 305 proximate the terminating distal end 329 of the first sheet portion 307.

Once appropriately assembled, the central portion 310, the first extension portion 311, and the second extension portion 312 are formed and the bifurcated trilobular packaging element 300 has an overall shape that is substantially similar to the shape of the assembled trilobular packaging element 300. However, it should be appreciated that the first extension portion 311 and the second extension portion 312 are not direct extensions from the central portion 310, as the first extension portion 311 and the second extension portion 312 are direct extensions from the central portion 310.

In various exemplary embodiments, the overlapped portions may be attached or coupled via an adhesive 340.

If attached or coupled by an adhesive 340, the adhesive 340 may comprise, for example, a hot melt, reactive hot melt, thermosetting, pressure sensitive, contact, binary, or other adhesive. In some embodiments, the wall portions may be pre-glued or may include an adhesive 340 that is initially covered by a removable strip so that the wall portions may be adhesively attached or coupled to one another by a user. Alternatively, the overlapped portions may be attached or coupled, via a mechanical or other means, such as, for example, stapling. In still other exemplary embodiments, the overlapping portions may be held in a desired position relative to one another by frictional engagement between the overlapping portions.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An integrally formed trilobular packaging element, comprising:

an integrally formed sheet formed of a portion of material, wherein said sheet extends from a first terminal end to a second terminal end;

one or more alternating ridges and grooves, formed along a continuous outer wall of said sheet, wherein each of said alternating ridges and grooves extends from said first terminal end to said second terminal end, and wherein said alternating ridges and grooves form a sinusoidal succession of waves or curves;

a first extension portion defined along a portion of said sheet;

a central portion defined along a portion of said sheet, extending from said first extension portion;

a second extension portion, defined along a portion of said sheet, extending from said central portion to said first extension portion, wherein a vertex of a first lobe is defined between said first extension portion and said central portion, wherein a vertex of a second lobe is defined between said central portion and said second extension portion, and wherein a vertex of a third lobe is defined between said second extension portion and said first extension portion; and a deformable hollow defined within at least a portion of said sheet.

2. The integrally formed trilobular packaging element of claim 1, wherein said sheet is formed of one continuous piece or portion of a common material.

3. The integrally formed trilobular packaging element of claim 1, wherein said sheet extends continuously, from said first terminal end to said second terminal end.

4. The integrally formed trilobular packaging element of claim 1, wherein said sheet comprises a single layer of material.

5. The integrally formed trilobular packaging element of claim 1, wherein said sheet comprises a continuous portion of paperboard, chipboard, container board, box board, cardboard, or corrugated fiberboard.

6. The integrally formed trilobular packaging element of claim 1, wherein each of said alternating ridges and grooves extends substantially parallel to a longitudinal axis of said sheet.

7. The integrally formed trilobular packaging element of claim 1, wherein said sheet is curvilinear along at least a portion of said continuous outer wall of said sheet.

8. The integrally formed trilobular packaging element of claim 1, wherein said sheet comprises a multi-layer sheet.

9. The integrally formed trilobular packaging element of claim 1, wherein said sheet comprises a laminate of a plurality of layers of material attached or coupled by an adhesive.

10. The integrally formed trilobular packaging element of claim 1, wherein said integrally formed trilobular packaging element forms a substantially triangular or trilobular shape.

11. The integrally formed trilobular packaging element of claim 1, wherein an angle formed between said first extension portion and said central portion and an angle formed between said second extension portion and said central portion are substantially similar.

12. The integrally formed trilobular packaging element of claim 1, wherein an angle formed between said first extension portion and said central portion and an angle formed between said second extension portion and said central portion is approximately ±130°.

13. The integrally formed trilobular packaging element of claim 1, wherein an angle formed between said first extension portion and said central portion and an angle formed between said second extension portion and said central portion is between approximately ±120° and ±140°.

14. The integrally formed trilobular packaging element of claim 1, wherein an angle formed between said first extension portion and said central portion and an angle formed between said second extension portion and said central portion are acute angles.

15. An integrally formed trilobular packaging element, comprising:

an integrally formed portion of material, wherein said portion of material has a continuous outer wall;

one or more alternating ridges and grooves, formed along said continuous outer wall of said portion of material, wherein each of said alternating ridges and grooves extends from a first terminal end of said portion of material to said second terminal end of said portion of material, and wherein said alternating ridges and grooves form a sinusoidal succession of waves or curves;

a first extension portion defined along a portion of said portion of material;

a central portion defined along a portion of said portion of material, extending from said first extension portion;

a second extension portion, defined along a portion of said portion of material, extending from said central portion to said first extension portion, wherein a vertex of a first lobe is defined between said first extension portion and said central portion, wherein a vertex of a second lobe is defined between said central portion and said second extension portion, and wherein a vertex of a third lobe is defined between said second extension portion and said first extension portion; and a deformable hollow defined within at least a portion of said portion of material.

16. The integrally formed trilobular packaging element of claim 15, wherein said continuous outer wall forms a substantially triangular or trilobular shape.

17. The integrally formed trilobular packaging element of claim 15, wherein said deformable hollow forms a substantially triangular or trilobular shape.

18. The integrally formed trilobular packaging element of claim 15, wherein said deformable hollow is defined by a continuous inner wall of said sheet.

19. The integrally formed trilobular packaging element of claim 15, wherein said deformable hollow is defined by a continuous inner wall of said sheet and wherein said continuous outer wall is substantially similarly shaped but offset from said continuous inner wall.

20. An integrally formed trilobular packaging element, comprising:

an integrally formed portion of material having a continuous outer wall and a substantially trilobular shape;

one or more alternating ridges and grooves, formed along said continuous outer wall of said portion of material, wherein each of said alternating ridges and grooves extends from a first terminal end of said portion of material to said second terminal end of said portion of material, and wherein said alternating ridges and grooves form a sinusoidal succession of waves or curves;

a deformable hollow defined within at least a portion of said portion of material, wherein said deformable hollow is defined by a continuous inner wall, and wherein said continuous outer wall is substantially similarly shaped but offset from said continuous inner wall;

a first extension portion defined along a portion of said portion of material;

a central portion defined along a portion of said portion of material, extending from said first extension portion; and a second extension portion, defined along a portion of said portion of material, extending from said central portion to said first extension portion, wherein a vertex of a first lobe is defined between said first extension portion and said central portion, wherein a vertex of a second lobe is defined between said central portion and said second extension portion, and wherein a vertex of a third lobe is defined between said second extension portion and said first extension portion.

* * * * *